US012359825B2

(12) United States Patent
Warren, Jr. et al.

(10) Patent No.: US 12,359,825 B2
(45) Date of Patent: Jul. 15, 2025

(54) MESH SCREEN TO PREVENT ACCESS TO HOT SURFACES WITHIN AN OVEN APPLIANCE

(71) Applicant: Haier US Appliance Solutions, Inc., Wilmington, DE (US)

(72) Inventors: Willie D. Warren, Jr., Ringgold, GA (US); Frank Jacob Hellwig, East Ridge, TN (US); Ishan Prakashrao Chimurkar, Lafayette, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 931 days.

(21) Appl. No.: 17/512,786

(22) Filed: Oct. 28, 2021

(65) Prior Publication Data

US 2023/0135267 A1 May 4, 2023

(51) Int. Cl.

| | |
|---|---|
| ***F24C 15/36*** | (2006.01) |
| ***F24C 15/00*** | (2006.01) |
| ***F24C 15/02*** | (2006.01) |
| ***F24C 15/28*** | (2006.01) |

(52) U.S. Cl.

CPC ..... *F24C 15/36* (2013.01); *F24C 15/006* (2013.01); *F24C 15/02* (2013.01); *F24C 15/28* (2013.01)

(58) Field of Classification Search

CPC ..... F24C 15/36; F24C 15/006; E04H 17/05
USPC ..... 454/367, 355, 354
See application file for complete search history.

(56) References Cited

U.S. PATENT DOCUMENTS 759,752 A * 5/1904 Rowland ..... E05D 7/1066 16/267
1,214,494 A * 2/1917 Allen ..... E06B 9/52 160/376
1,480,505 A * 1/1924 Hutchison ..... A47J 36/2405 126/39 R
2,272,196 A * 2/1942 Gittens ..... E06B 9/52 245/1
3,001,606 A * 9/1961 Bierwirth ..... F24F 1/035 55/471
3,310,046 A * 3/1967 Scott ..... F24C 14/02 219/393
3,331,942 A * 7/1967 Scott ..... F24C 15/006 219/391
3,659,579 A * 5/1972 Henderson ..... F24C 15/006 126/41 R
3,889,099 A * 6/1975 Nuss ..... F24C 15/02 219/393

(Continued)

FOREIGN PATENT DOCUMENTS

CN 209003183 U 6/2019
FR 2379029 A1 * 8/1978

*Primary Examiner* — Jorge A Pereiro
(74) *Attorney, Agent, or Firm* — Dority & Manning, P.A.

(57) ABSTRACT

An oven appliance includes a cabinet, a plurality of walls positioned therein to define a cooking chamber, and a door that provides selective access to the cooking chamber. An air passageway is defined through the door and around the cooking chamber between the plurality of walls and the cabinet. An air handler draws cooling air into the air passageway through an intake aperture and discharges the cooling air through a discharge aperture. A mesh screen is positioned over the discharge aperture of the air passageway to restrict access to hot surfaces within the cabinet.

16 Claims, 7 Drawing Sheets

(56) References Cited

U.S. PATENT DOCUMENTS 3,889,100 A * 6/1975 Dills ..... F24C 15/006 219/393
3,924,601 A * 12/1975 Nuss ..... F24C 15/006 126/21 R
4,007,672 A * 2/1977 Luckey ..... F24F 13/08 52/95
4,180,049 A * 12/1979 Carr ..... H05B 6/642 219/400
4,587,997 A * 5/1986 Brooks ..... D03D 15/00 139/420 R
4,653,464 A * 3/1987 Kojima ..... F24C 1/14 126/96
5,107,821 A * 4/1992 von Blanquet ..... F24C 15/04 126/198
5,547,422 A * 8/1996 Seboldt ..... F24F 13/08 34/235
5,632,678 A * 5/1997 Doelfel ..... F24F 7/02 454/366
D397,431 S * 8/1998 Meyer ..... D23/371
5,916,023 A * 6/1999 Meyer ..... D06F 58/14 34/235
5,918,589 A * 7/1999 Valle ..... F24C 15/006 126/193
6,116,294 A * 9/2000 Willson ..... B21F 27/02 140/3 R
6,149,701 A * 11/2000 Ellingson ..... B01D 46/0005 55/494
6,197,077 B1 * 3/2001 Simmons ..... B01D 46/10 55/491
6,889,201 B1 * 5/2005 Reed ..... G06Q 10/087 705/26.7
6,941,706 B2 * 9/2005 Austin ..... E04D 13/178 52/95
7,503,844 B1 * 3/2009 Vidler, Jr. ..... F24F 13/084 454/316
8,448,733 B2 5/2013 Khouw
9,643,037 B2 * 5/2017 Vermeersch ..... A62C 4/00
2005/0133019 A1 * 6/2005 Kim ..... F24C 15/006 126/198
2005/0148295 A1 * 7/2005 Koessler ..... F24F 7/02 454/366
2005/0279063 A1 * 12/2005 Simmons ..... B01D 46/0005 55/495
2005/0279064 A1 * 12/2005 Simmons ..... F28F 19/01 55/495
2006/0219234 A1 * 10/2006 Larsen ..... F24C 15/006 126/21 R
2007/0161346 A1 * 7/2007 Landon ..... F23K 5/16 454/339
2008/0184985 A1 * 8/2008 Hasslberger ..... F24C 15/006 126/21 R
2009/0050130 A1 * 2/2009 Kim ..... F24C 15/2007 126/21 A
2010/0065035 A1 * 3/2010 Armstrong ..... F24C 15/006 126/198
2010/0065036 A1 * 3/2010 Watkins ..... F24C 15/006 126/198
2010/0139640 A1 * 6/2010 Watkins ..... F24C 15/006 126/21 A
2011/0052774 A1 * 3/2011 Sajjad ..... F24C 15/006 426/523
2011/0076937 A1 * 3/2011 Greenberg ..... F24F 13/082 454/367
2011/0312262 A1 * 12/2011 Grandmaison ..... F24F 13/084 454/276
2013/0025364 A1 * 1/2013 Bach ..... G01F 1/688 73/204.23
2013/0025581 A1 * 1/2013 Elkasevic ..... F24C 15/006 126/21 R
2013/0035030 A1 * 2/2013 Bach ..... G01F 1/34 454/256
2016/0061237 A1 * 3/2016 Koberstein ..... B60H 1/0005 237/12.3 A
2017/0336079 A1 11/2017 Braden
2019/0107290 A1 * 4/2019 Signorino ..... F24C 15/008
2019/0114935 A1 * 4/2019 Nolan ..... F24C 15/2064
2019/0154267 A1 * 5/2019 Garces ..... F24C 3/124
2019/0390857 A1 * 12/2019 Bruin-Slot ..... F24C 15/322
2020/0191406 A1 * 6/2020 Yun ..... F24C 15/025
2020/0208844 A1 * 7/2020 Bruin-Slot ..... F24C 15/322

* cited by examiner

MESH SCREEN TO PREVENT ACCESS TO HOT SURFACES WITHIN AN OVEN APPLIANCE

FIELD OF THE INVENTION

The present subject matter relates generally to oven appliances, and more particularly, to safety features that reduce access to hot surfaces within oven appliances.

BACKGROUND OF THE INVENTION

Conventional residential and commercial oven appliances generally include a cabinet that includes a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber.

Conventional oven appliances include a door that provides selective access to the cooking chamber and that typically includes a window to permit a user to view a cooking process. In order to maintain suitably cool outer surfaces of the oven appliances, an air passageway may surround the cooking chamber and an air circulating device may circulate cooling air through the air passageway. However, the intake and the discharge of such air passageways may be positioned below the oven door and may be accessible to appliance users or other humans (e.g., children). Notably, surfaces within this air passageway may still be dangerously hot and openings to the air passageway may be positioned low enough that young children may touch such surfaces.

Accordingly, an oven appliance that includes improved features for reducing contact with hot surfaces would be useful. More particularly, an oven appliance with features for preventing access into the cabinet through the air passageway would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, an oven appliance defining a vertical, a lateral, and a transverse direction is provided. The oven appliance includes a cabinet, a plurality of walls positioned within the cabinet to define a cooking chamber, a door rotatably mounted to the cabinet for providing selective access to the cooking chamber, an air passageway defined at least partially between the plurality of walls and the cabinet, the air passageway comprising an intake aperture and a discharge aperture, and a mesh screen positioned over the discharge aperture of the air passageway.

In another exemplary embodiment, a wall oven defining a vertical, a lateral, and a transverse direction is provided. The wall oven includes a cooking chamber positioned within a cabinet, a door rotatably mounted to the cabinet for providing selective access to the cooking chamber, an air passageway that wraps around the cooking chamber, extending from an intake aperture defined at a bottom of the door and a discharge aperture defined below the door, a horizontal brace that extends between a left side and a right side of the cabinet along the lateral direction, and a mesh screen mounted to the horizontal brace over the discharge aperture of the air passageway.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
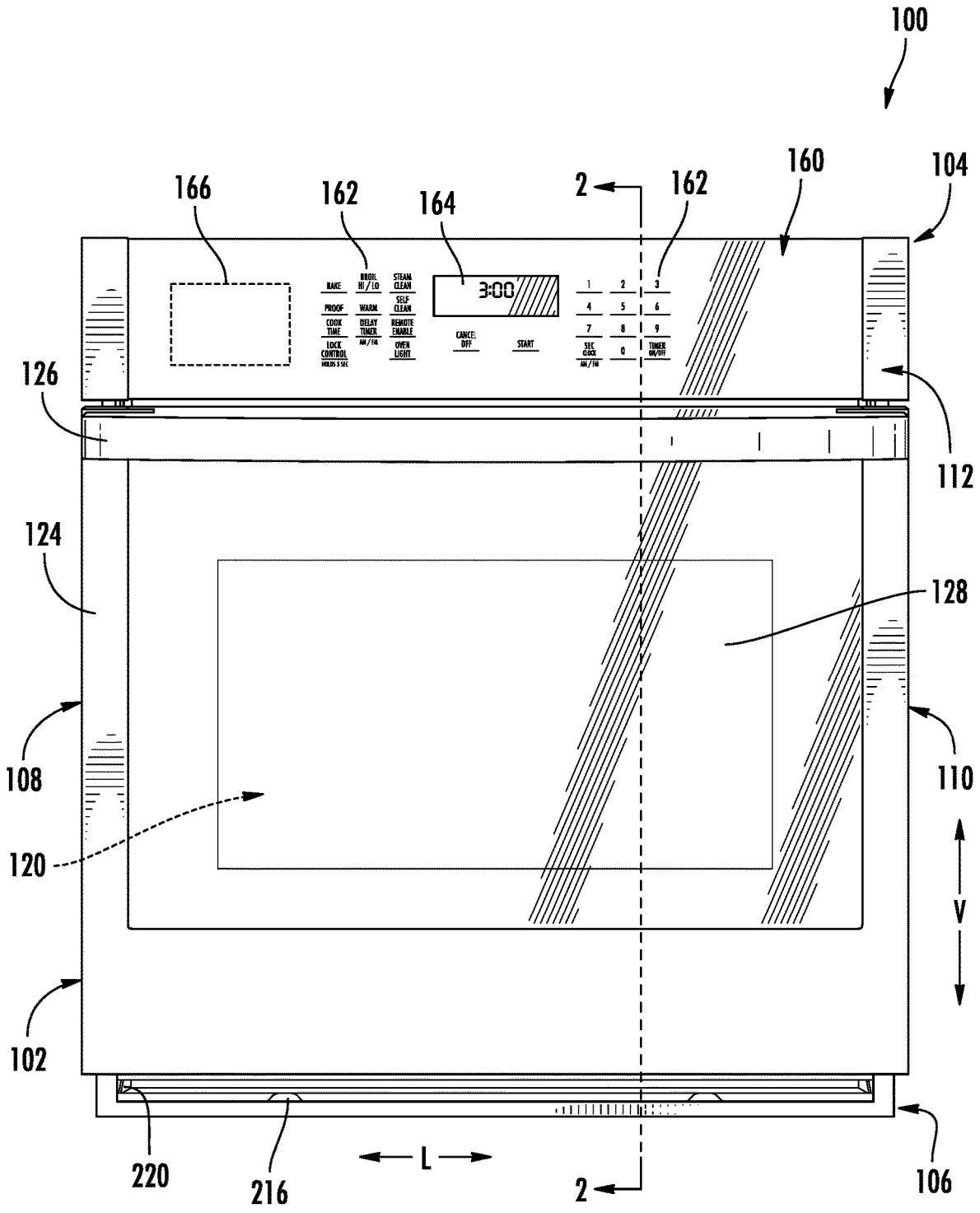
FIG. 1 is a front view of an oven appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
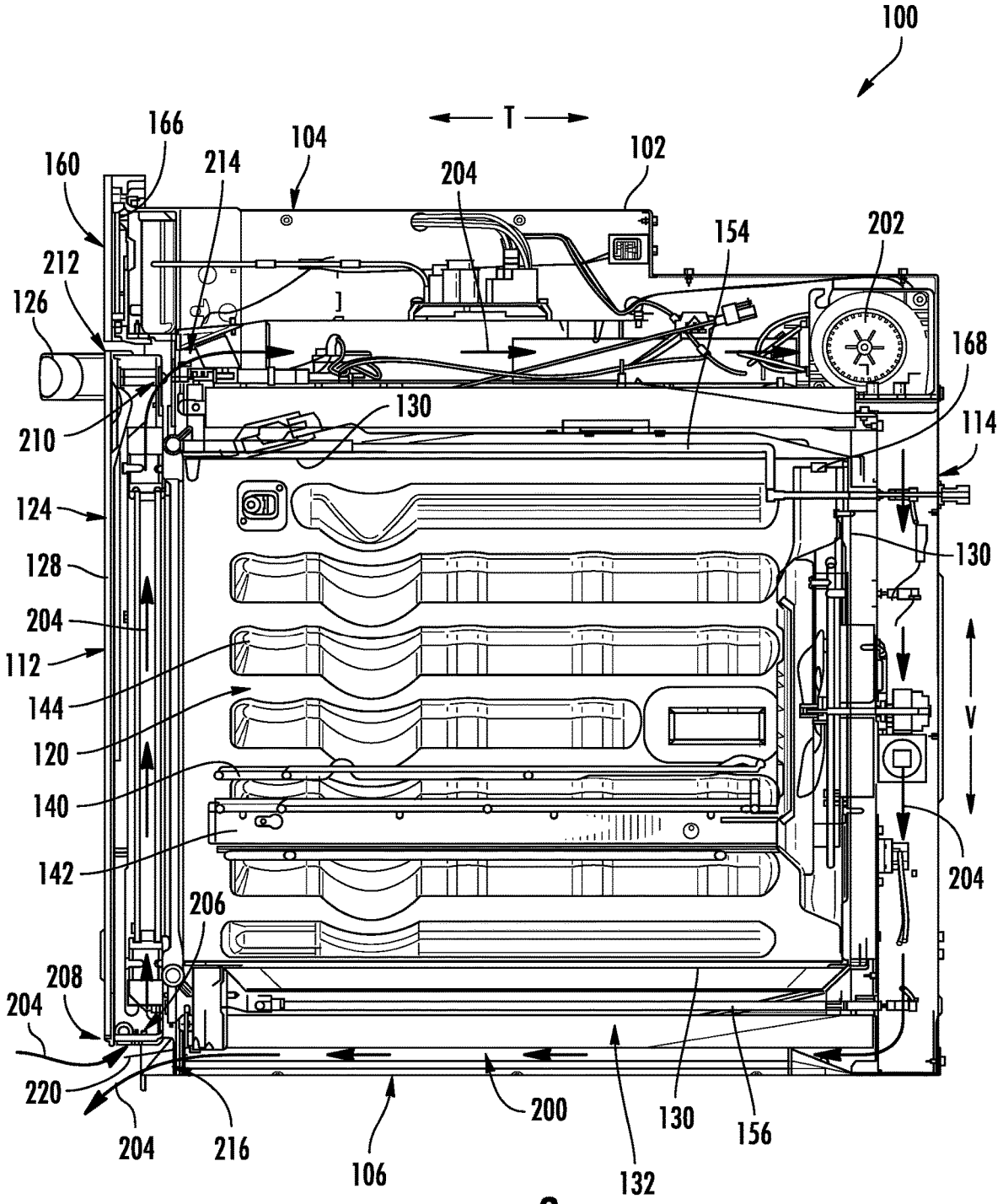
FIG. 2 is a side, cross-sectional view of the exemplary oven appliance of FIG. 1, taken along Line 2-2 in FIG. 1.
Figure 3:
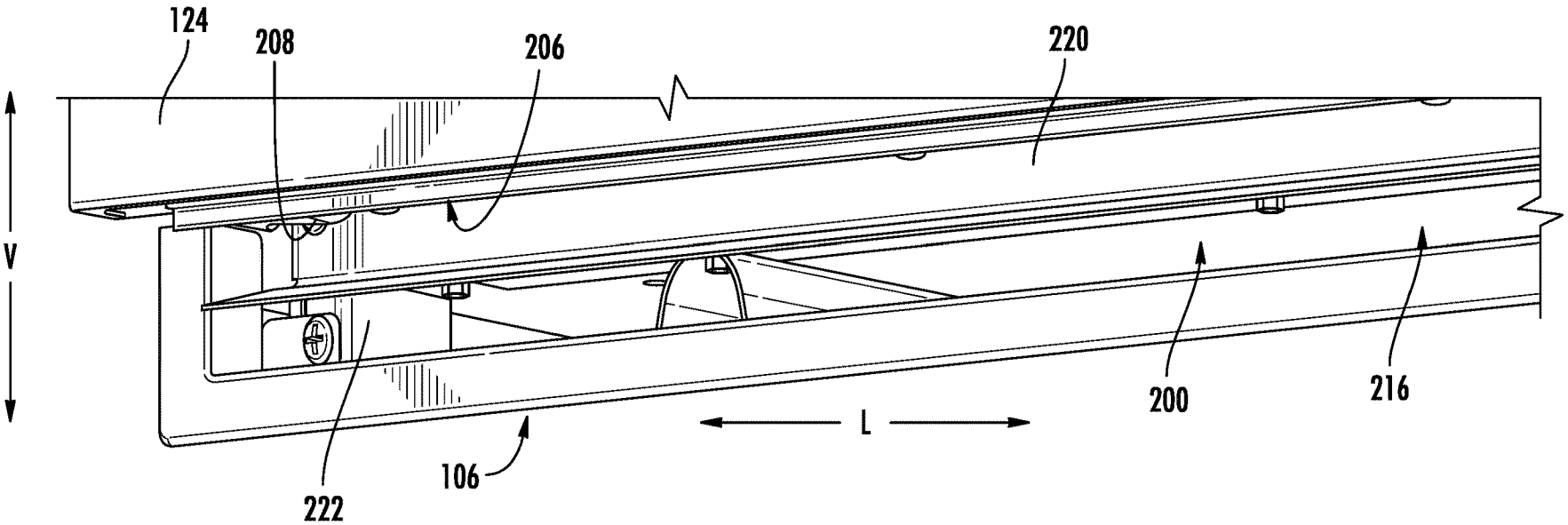
FIG. 3 is a perspective view of an intake aperture and a discharge aperture of an air passageway (with a mesh screen removed for clarity) of the exemplary oven appliance of FIG. 1.

FIG. 1 provides a front view of an oven appliance 100 as may be employed with the present subject matter. In addition, FIGS. 2 and 3 provide perspective and side cross-sectional views, respectively, of oven appliance 100. As shown, oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a gas or electric double oven range appliance. For example, although oven appliance 100 is illustrated as a wall oven that is installable within a bank of cabinets, it should be appreciated that aspects of the present subject matter may be used in free-standing oven appliances, double ovens, etc. Thus, the example embodiment shown in FIGS. 1 through 3 is not intended to limit the present subject matter to any particular cooking chamber configuration or arrangement.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

In general, cooking chamber 120 is defined by a plurality of chamber walls 130 (see, e.g., FIG. 2). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Referring still to FIG. 2, oven appliance 100 may include a plurality of racks 140 positioned within cooking chamber 120 for receiving food or cooking utensils containing food items. Racks 140 provide support for such food during a cooking process. According to the illustrated embodiment, racks 140 may be slidably mounted within cooking chamber 120 by one or more slide assemblies 142 that are mounted to a sidewall 130 of cooking chamber 120. Alternatively, racks 140 may be slidably received onto embossed ribs or sliding rails such that racks 140 may be conveniently moved into and out of cooking chamber 120.

As best shown in FIG. 2, oven appliance may include six rack supports 144 that are spaced apart along the vertical direction V. In addition, oven appliance 100 may include racks 140 that may each be slidably positioned on each of the six rack supports 128, such that six total rack positions are possible within cooking chamber 120. However, it should be appreciated that according to alternative embodiments, any suitable number of racks mounted in cooking chamber 120 in any suitable manner and being movable between any suitable number of positions is possible and within the scope of the present subject matter.

Oven appliance may further include one or more heating elements positioned within cabinet 102 or may otherwise be in thermal communication with cooking chamber 120 for regulating the temperature within cooking chamber 120. For example, the heating elements may be electric resistance heating elements, gas burners, microwave heating elements, halogen heating elements, or suitable combinations thereof. According to an exemplary embodiment, oven appliance 100 is a self-cleaning oven. In this regard, the heating elements may be configured for heating cooking chamber 120 to a very high temperature (e.g., 800° F. or higher) in order to burn off any food residue or otherwise clean cooking chamber 120.

Specifically, an upper gas or electric heating element 154 (also referred to as a broil heating element or gas burner) may be positioned in cabinet 102, e.g., at a top portion of cooking chamber 120, and a lower gas or electric heating element 156 (also referred to as a bake heating element or gas burner) may be positioned at a bottom portion of cooking chamber 120. Upper heating element 154 and lower heating element 156 may be used independently or simultaneously to heat cooking chamber 120, perform a baking or broil operation, perform a cleaning cycle, etc. The size and heat output of heating elements 154, 156 can be selected based on the, e.g., the size of oven appliance 100 or the desired heat output. Oven appliance 100 may include any other suitable number, type, and configuration of the heating elements within cabinet 102. For example, oven appliance 100 may further include electric heating elements, induction heating elements, or any other suitable heat generating device.

A user interface panel 160 is located within convenient reach of a user of the oven appliance 100. For this example embodiment, user interface panel 160 includes user inputs 162 that may generally be configured for regulating the heating elements or operation of oven appliance 100. In this manner, user inputs 162 allow the user to activate each heating element and determine the amount of heat input provided by each heating element to a cooking food items within cooking chamber 120. Although shown with user inputs 162, it should be understood that user inputs 162 and the configuration of oven appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element is activated and/or the rate at which the heating element is set.

Generally, oven appliance 100 may include a controller 166 in operative communication with user interface panel 160. User interface panel 160 of oven appliance 100 may be in communication with controller 166 via, for example, one or more signal lines or shared communication busses, and signals generated in controller 166 operate oven appliance 100 in response to user input via user inputs 162. Input/Output ("I/O") signals may be routed between controller 166 and various operational components of oven appliance 100 such that operation of oven appliance 100 can be regulated by controller 166. In addition, controller 166 may also be communication with one or more sensors, such as a temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Referring now generally to FIGS. 2 through 9, an airflow system and associated safety features that may be used with oven appliance 100 will be described according to exemplary embodiments of the present subject matter. In this regard, oven appliance 100 may generally define an air passageway 200 through which an air handler 202 circulates a flow of air (e.g., identified generally by reference numeral 204) around cooking chamber 120. This flow of air 204 is generally configured for reducing the temperature of cabinet 102 such that oven appliance 100 may be a wall oven and may contact cabinetry and other structures without causing a fire hazard.

Specifically, according to the illustrated embodiment, air passageway 200 is defined at least partially through the door 124 and then passes around cooking chamber 120 (e.g., between the chamber walls 130 that define cooking chamber 120 and insulated cabinet 102.) Air passageway 200 includes an intake aperture 206 that is defined on a bottom end 208 of door 124. More specifically, intake aperture 206 may extend across a width and depth of door 124 and door 124 may define an internal passage for directing the flow of air 204 upward through door 124.

Referring still specifically to FIG. 2, door 124 may define a door discharge port 210 at or approximate top end 212 of door 124. Similarly, cabinet 102 or chamber walls 130 may define an upper intake 214 that is positioned adjacent door discharge port 210. In this manner, the flow of air 204 may be drawn into intake aperture 206 and may be directed upward through door 124 before being discharged through door discharge port 210 directly into upper intake 214. The flow of air 204 may then pass around cooking chamber 120, thereby cooling chamber walls 130 or otherwise limiting the transfer of thermal energy from cooking chamber 120 to insulated cabinet 102. It should be appreciated that various other components may be positioned within the space defined between chamber walls 130 and cabinet 102, such as insulation and an insulation retainer, and that the flow of air may pass around these components.

After the flow of air 204 has wrapped around cooking chamber 120, it may be directed forward along the transverse direction T toward a discharge aperture 216 of air passageway 200. In this regard, discharge aperture 216 may generally be defined between insulated cabinet 102 and the bottom chamber wall 130 of cooking chamber 120. Discharge aperture 216 may extend along the entire width of oven appliance 100 and may generally direct air 204 outward along the transverse direction T.

Figure 4:
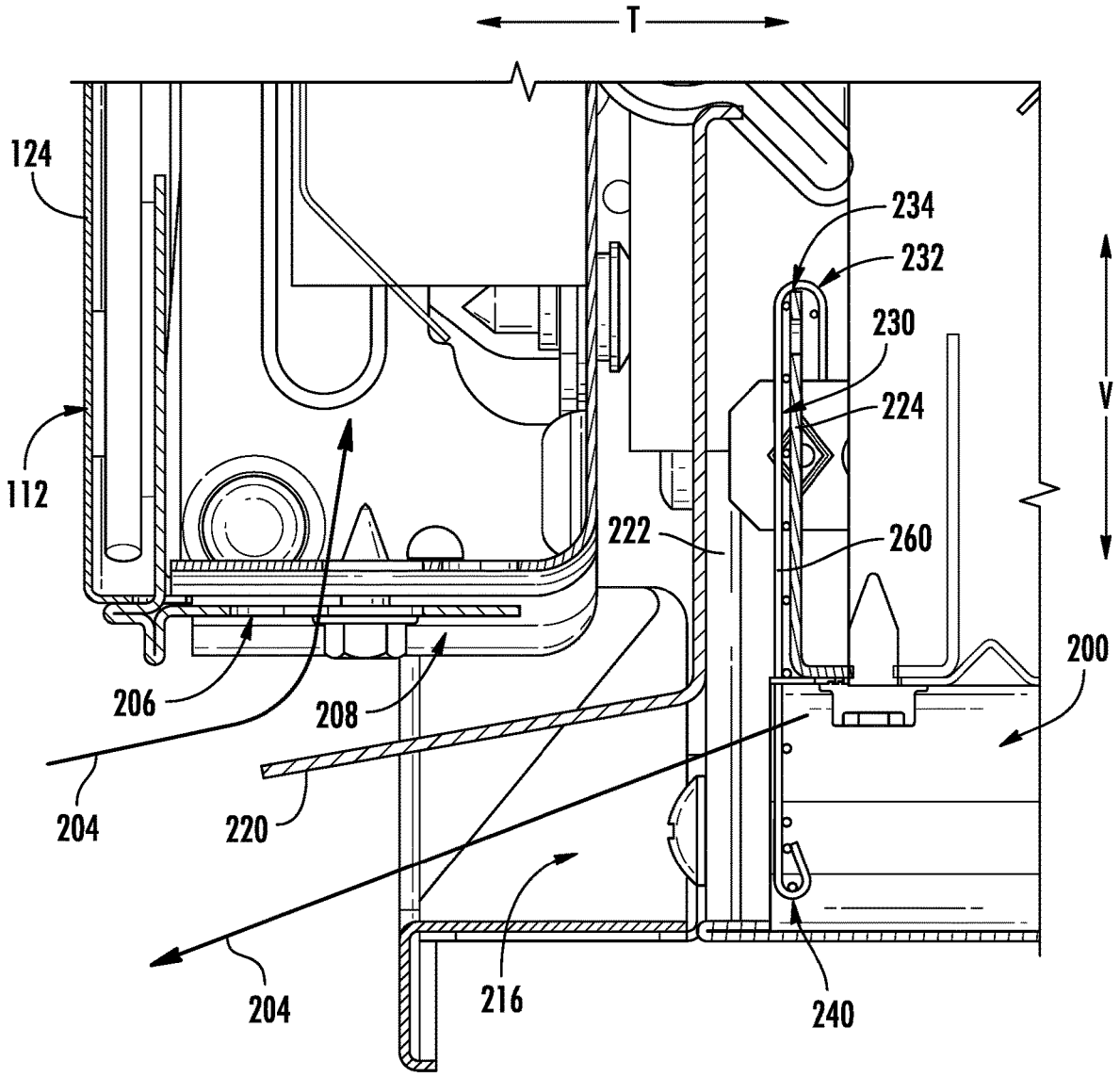
FIG. 4 provides a side, cross sectional view of the exemplary intake aperture and discharge aperture of FIG. 3.
Figure 5:
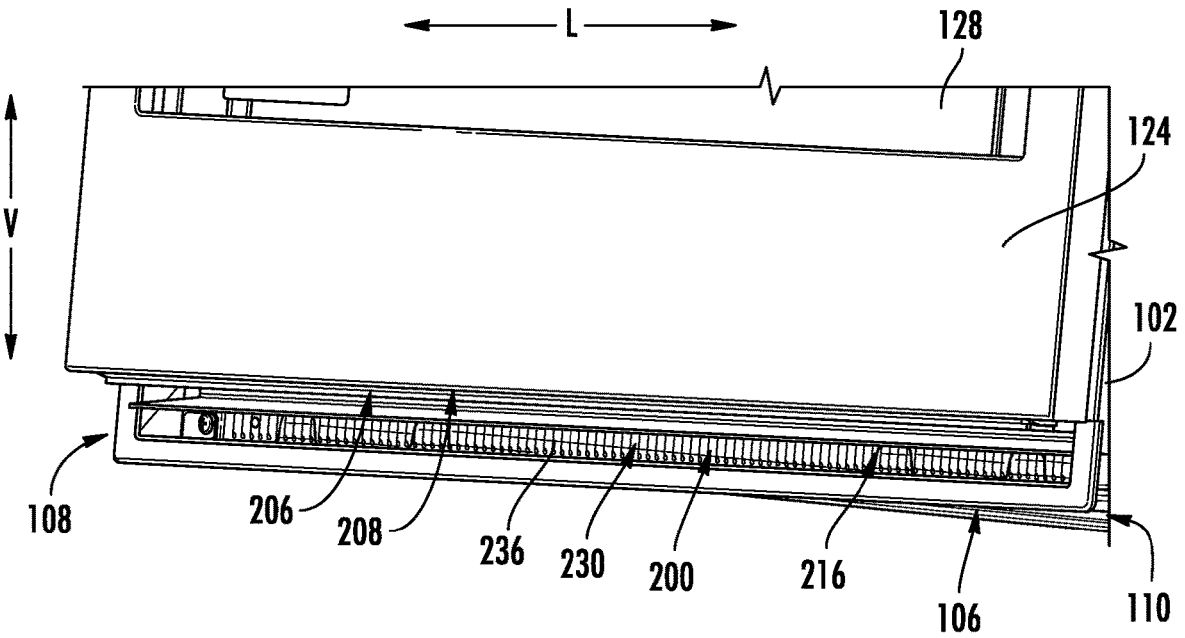
FIG. 5 is a perspective view of the exemplary discharge aperture of FIG. 3 covered by a mesh screen according to an exemplary embodiment of the present subject matter.
Figure 6:
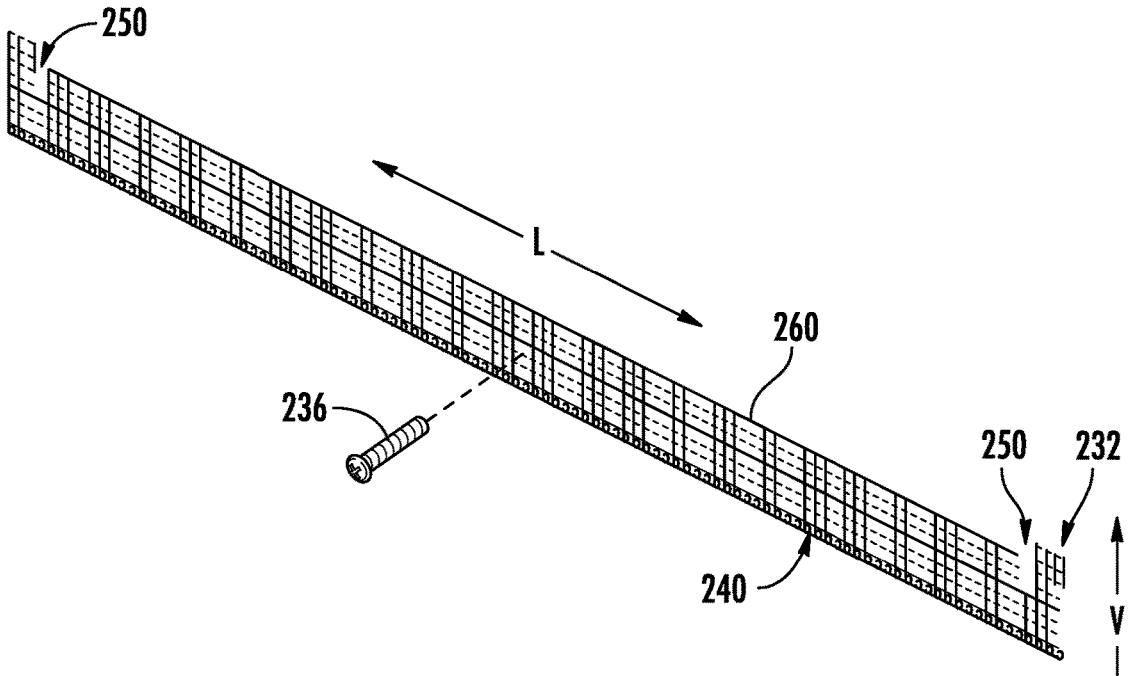
FIG. 6 provides a perspective view of the exemplary mesh screen of FIG. 5 according to an exemplary embodiment of the present subject matter.
Figure 7:
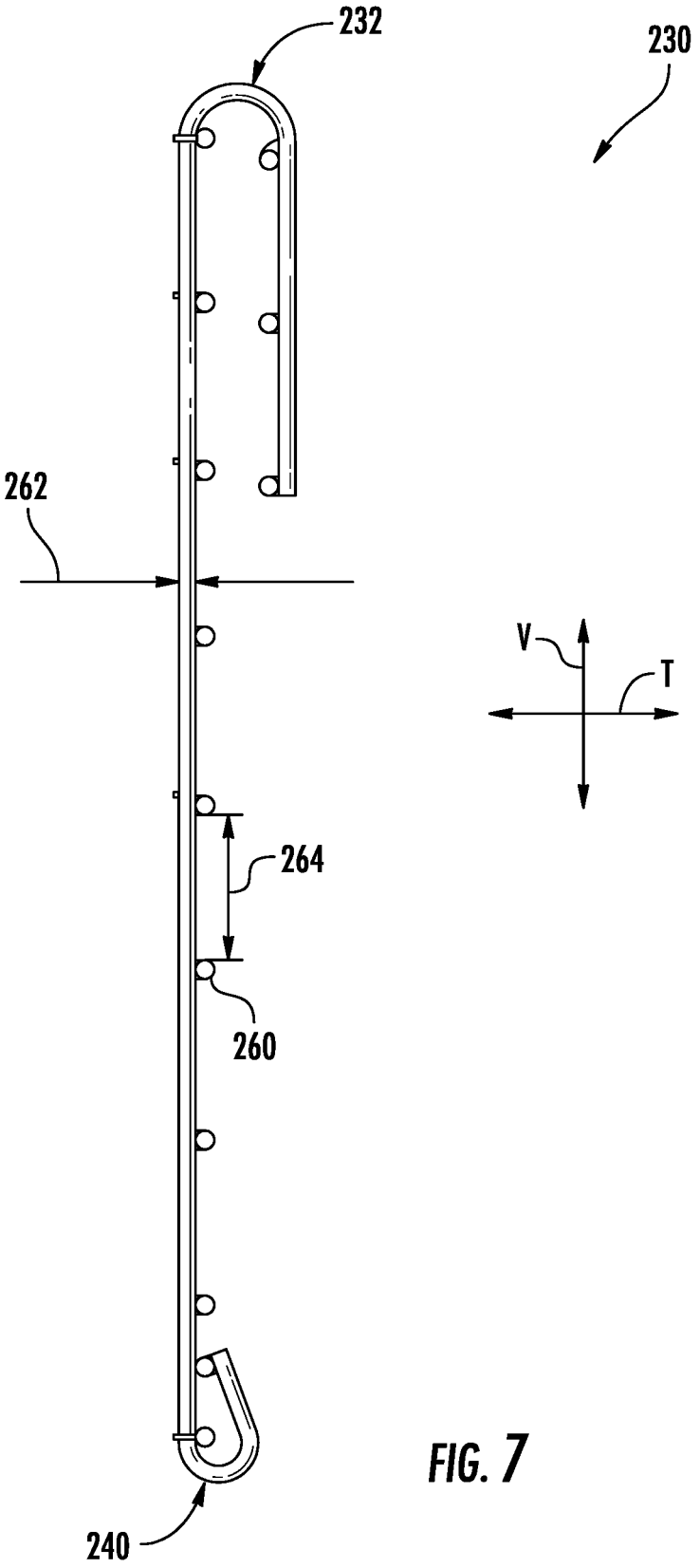
FIG. 7 provides a side view of the exemplary mesh screen of FIG. 5 according to an exemplary embodiment of the present subject matter.
Figure 8:
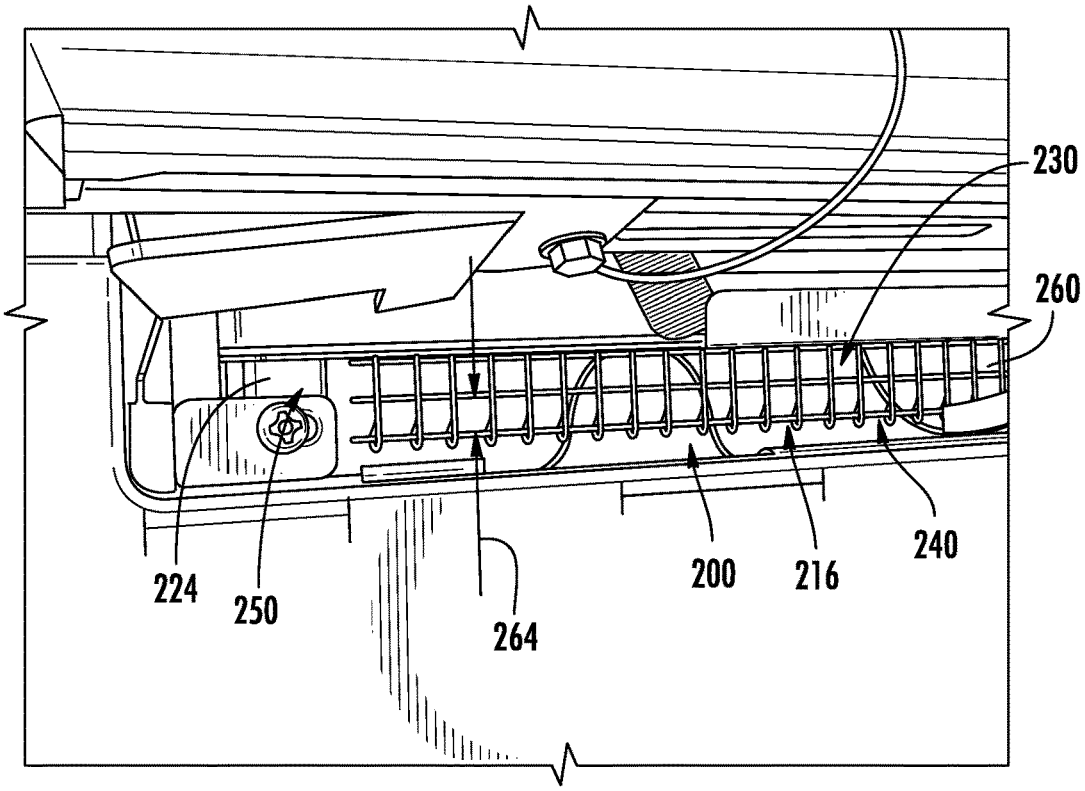
FIG. 8 provides a perspective view of the exemplary mesh screen of FIG. 5 covering the discharge aperture according to an exemplary embodiment of the present subject matter.
Figure 9:
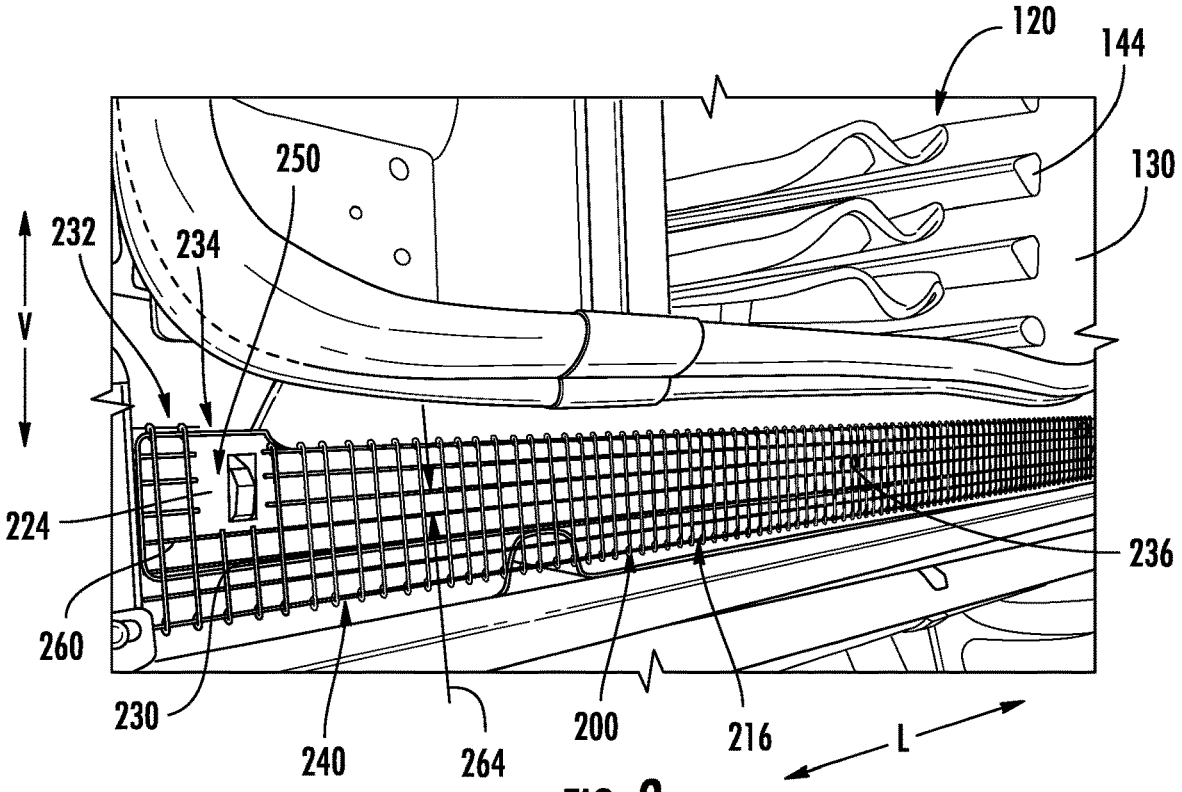
FIG. 9 provides another perspective view of the exemplary mesh screen of FIG. 5 covering the discharge aperture with the door and flow diverter removed for clarity according to an exemplary embodiment of the present subject matter.

As best shown in FIGS. 3 and 4, oven appliance 100 may further include a flow diverter 220 that is positioned below the bottom end 208 of door and above discharge aperture 206 to separate or generally isolate intake aperture 206 from discharge aperture 216. In this regard, flow diverter 220 may generally be mounted to a vertical support frame 222 of cabinet 102. As shown, flow diverter 220 is generally angled down and away from a front end of cooking chamber 120 such that a substantially fresh flow of air may be drawn in through intake aperture 206 without mixing with the hot air discharged through discharge aperture 216. Although flow diverter 220 is illustrated as having a particular geometry, size, and construction, it should be appreciated that flow diverter 220 may be varied while remaining within the scope of the present subject matter. For example, the angle and length of flow diverter 220 may be adjusted to properly balance intake air and discharge air.

Referring still to FIG. 4, oven appliance 100 may include a horizontal brace 224 that extends between a left side 108 and a right side 110 of cabinet 102 along the lateral direction L. for example, according to the illustrated embodiment, horizontal brace 224 is positioned behind flow diverter 220 along the transverse direction T and generally defines discharge aperture 216 extending along the lateral direction L. Horizontal brace 224 may also extend along the vertical direction V between bottom 106 of cabinet 102 and to a bottom chamber wall 130 of cooking chamber 120. In general, according to an exemplary embodiment, horizontal brace 224 extends along a front of cabinet 102 and is connected to the sides of cabinet 102 (or to vertical braces mounted thereto) and generally acts as a structural member for supporting various components of oven appliance 100 and providing structural rigidity to oven appliance 100.

Notably, the dimensions of discharge aperture 216 may generally be large enough so as not to restrict the amount of air flow passing through air passageway 200. In this manner, sufficient cooling of chamber walls 130 may be maintained. However, due to the dimensions of discharge aperture 216 users may be able to contact hot surfaces of oven appliance 100 by reaching through discharge aperture 216. More particularly, when oven appliance 100 is a wall oven, discharge aperture 216 is generally positioned at a height that is accessible to young children who may place their hands through discharge aperture 216 and contact hot surfaces within air passageway 200. Accordingly, aspects of the present subject matter are directed to features for restricting such access and to comply with particular Underwriters Laboratories ("UL") requirements regarding use accessibility to hot surfaces.

More particularly, as best illustrated in FIGS. 4 through 9, oven appliance 100 may further include a mesh screen 230 that is generally mounted over discharge aperture 216 for preventing access into air passageway 200. In this manner, mesh screen 230 is generally designed to prevent users or young children from placing their fingers into air passageway 200 and contacting hot surfaces of oven appliance 100. Although an exemplary installation of mesh screen 230 will be described below according to exemplary embodiments, it should be appreciated that variations and modifications may be made to the mesh screen 230 geometry and construction while remaining within scope the present subject matter. In addition, it should be appreciated that the way mesh screen 230 is installed into an oven appliance may vary while remaining within the scope of the present subject matter.

According to the illustrated embodiment, mesh screen 230 is generally mounted to horizontal brace 224. More specifically, according to the illustrated embodiment, mesh screen 230 may define a top hooked end 232 that extends along a width of mesh screen 230. Top hooked end 232 may be positioned over a top 234 of horizontal brace 224. In this regard, top hooked end 232 wraps from a front face of horizontal brace 224, around top 234, and along the backside of horizontal brace 224. In this manner, during the manufacturing process, a technician may position mesh screen 230 on horizontal brace 224 such that it hangs freely. This may permit the technician to have free hands to install a mechanical fastener 236 (FIG. 9) that secures mesh screen 230 to horizontal brace 224. In this manner, mesh screen 230 provides an easy to install and low-cost solution to prevent safety issues associated with users contacting hot surfaces within air passageway 200.

Referring now specifically to FIG. 4, mesh screen 230 may also be positioned between horizontal brace 224 and flow diverter 220. In addition, mesh screen 230 may further include a bottom end 240 that is curled over or blunted as a safety edge to prevent cuts to the installation technician or to a user of the appliance. In addition, referring for example to FIGS. 5 and 6, mesh screen 230 may define additional features that facilitate easy installation around existing flanges and fasteners of oven appliance 100. In this regard, mesh screen 230 may define one or more clearance slots 250 that are configured for wrapping around or receiving one or more flanges or mechanical fasteners of oven appliance 100 when mesh screen 230 is in the installed position.

In general, mesh screen 230 may be formed from any material that is suitably rigid to prevent access to air passageway 200. For example, mesh screen 230 may be formed from metal wire, a rigid plastic, or any other suitable material. According to the illustrated embodiment, mesh screen 230 comprises a plurality of interwoven wires 260. For example, these wires may be formed from metal. In addition, in order to provide sufficient rigidity while minimizing air restrictions, each of the plurality of interwoven wires 260 may have a diameter 262 of between about 0.005 and 0.1 inches, between about 0.01 and 0.05 inches, or about 0.025 inches or less. In addition, the plurality of interwoven wires 260 may be spaced apart such that mesh screen 230 defines an average aperture size or width 264 that is sufficient to not restrict airflow while providing sufficient rigidity. For example, mesh screen 230 may define an aperture size 264 that is between about 0.01 and 0.5 inches, between about 0.1 and 0.4 inches, or about 0.25 inches or less. More specifically, according to an exemplary embodiment, aperture size 264 may be less than 0.339 inches, such that a probe of that size may not fit through mesh screen, thereby satisfying Underwriters Laboratories ("UL") requirements regarding use accessibility to hot surfaces.

Aspects of the present subject matter are directed to a wire mesh for blocking accessibility to high temperature areas in a wall oven. In this regard, UL requirements for wall ovens may require restricted access to surfaces over a certain temperature when installed at a height of less than 31 inches and operated at 475° F. bake mode. The present disclosure contemplates the wire mesh comprising hook arrangements at its top to mount with a horizontal brace at the bottom of the wall oven and is secured by a screw at the center. The mesh size may be about 0.250 inches per square and mesh wire size may be about 0.025 inches, thereby preventing probe access per UL requirements. The wire mesh also blocks finger probe access to lower air duct area without obstructing air flow by not allowing the 0.339 inches probe tip to enter into higher temperature areas. The wire mesh is easy to install, cost effective, and an ideal safety measure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A wall oven defining a vertical, a lateral, and a transverse direction, the wall oven comprising:

a cooking chamber positioned within a cabinet;

a door rotatably mounted to the cabinet for providing selective access to the cooking chamber;

an air passageway that wraps around the cooking chamber, extending from an intake aperture defined at a bottom of the door and a discharge aperture defined below the door;

a horizontal brace that extends between a left side and a right side of the cabinet along the lateral direction;

a mesh screen mounted to the horizontal brace over the discharge aperture of the air passageway; and a flow diverter positioned in front of the mesh screen such that the mesh screen is behind the flow diverter and in front of the horizontal brace.

2. The wall oven of claim 1, wherein the mesh screen defines a top hooked end that is positioned over a top of the horizontal brace.

3. The wall oven of claim 1, wherein the mesh screen is attached to the horizontal brace with one or more mechanical fasteners.

4. The wall oven of claim 1, wherein a bottom end of the mesh screen is curled over or blunted as a safety edge.

5. The wall oven of claim 1, wherein the mesh screen defines an average aperture size of less than 0.339 inches, and wherein the mesh screen comprises a plurality of interwoven metal wires, each of the plurality of interwoven metal wires having a diameter of less than 0.025 inches.

6. An oven appliance defining a vertical, a lateral, and a transverse direction, the oven appliance comprising:

a cabinet;

a plurality of walls positioned within the cabinet to define a cooking chamber;

a door rotatably mounted to the cabinet for providing selective access to the cooking chamber;

an air passageway defined at least partially between the plurality of walls and the cabinet, the air passageway comprising an intake aperture and a discharge aperture;

a mesh screen positioned over the discharge aperture of the air passageway;

a horizontal brace that extends between a left side and a right side of the cabinet along the lateral direction, wherein the mesh screen is mounted to the horizontal brace; and a flow diverter positioned in front of the mesh screen such that the mesh screen is behind the flow diverter and in front of the horizontal brace.

7. The oven appliance of claim 6, wherein the air passageway is defined at least partially within the door and wherein the intake aperture is defined at a bottom of the door.

8. The oven appliance of claim 7, wherein a flow diverter is positioned below a bottom of the door to separate the intake aperture from the discharge aperture.

9. The oven appliance of claim 1, wherein the mesh screen defines a top hooked end that is positioned over a top of the horizontal brace.

10. The oven appliance of claim 1, wherein the mesh screen is attached to the horizontal brace with one or more mechanical fasteners.

11. The oven appliance of claim 1, wherein the mesh screen defines one or more clearance slots configured for receiving one or more mechanical fasteners when the mesh screen is in an installed position.

12. The oven appliance of claim 1, wherein a bottom end of the mesh screen is curled over or blunted as a safety edge.

13. The oven appliance of claim 1, wherein the mesh screen defines an average aperture size of less than 0.339 inches.

14. The oven appliance of claim 1, wherein the mesh screen comprises a plurality of interwoven wires, each of the plurality of interwoven wires having a diameter of less than 0.025 inches.

15. The oven appliance of claim 1, wherein the mesh screen is formed from metal.

16. The oven appliance of claim 1, wherein the oven appliance is a wall mounted oven appliance.

* * * * *